United States Patent [19]

Thompson et al.

[11] 4,177,591

[45] Dec. 11, 1979

[54] COPY HOLDER

[75] Inventors: John J. Thompson; Paul D. Gorman, both of New York, N.Y.; Patrick Dowd, Paramus, N.J.

[73] Assignee: Pres-To-Line Corporation of America, New York, N.Y.

[21] Appl. No.: 882,161

[22] Filed: Feb. 28, 1978

[51] Int. Cl.[2] ..... B41J 11/36

[52] U.S. Cl. ..... 40/343; 40/463

[58] Field of Search ..... 40/341, 343, 342, 466, 40/463; 35/35 B

[56] References Cited

U.S. PATENT DOCUMENTS

| | | | |
|---|---|---|---|
| 1,439,250 | 12/1922 | MacDowell | 40/343 |
| 2,737,156 | 3/1956 | Denver | 40/343 |
| 2,949,886 | 8/1960 | Tibbling | 40/343 |
| 3,126,648 | 3/1964 | Strong et al. | 35/35 B |
| 3,449,849 | 6/1969 | Di Pasquzle et al. | 40/343 |

*Primary Examiner*—Louis G. Mancene
*Assistant Examiner*—Wenceslao J. Contreras
*Attorney, Agent, or Firm*—Hopgood, Calimafde, Kalil, Blaustein & Lieberman

[57] ABSTRACT

The invention contemplates improved means of control for a copy holder, for example, a roll-operated positioning device for a data draft or the like sheet to be copied by a typist, so that the eye can be guided correctly on a line-by-line basis. The improved control provides precise electric-motor drive for each of a plurality of selected different paper-displacing increments, at least one of the increments being selectively adjustable to exactly match the line spacing unique to the particular paper from which the copy is to be made.

11 Claims, 3 Drawing Figures

COPY HOLDER

The invention relates to copy holders used as adjuncts to typewriters, and other key-operated machines, to bring into view, line by line, or otherwise as desired, written data to be typed or entered by the operator.

The copy holder is a self-contained unit positioned as desired near a typewriter or other keyboard machine to hold a data sheet in face view of the operator. The head of the copy holder receives the data sheet between feed-roller means on a platen shaft and coacting pressure rolls. Illustrative of such devices is U.S. Pat. No. 2,095,904 wherein a mechanical clutch and lever system is employed to impart line-indexing motion to the platen, and U.S. Pat. No. 3,369,313 wherein a solenoid-operated ratchet system is employed for the line-indexing purpose. But helpful as such mechanisms may be, they are imprecise and are therefore subject to cumulative error, resulting in incremental copy advances which either result in a skipped line or a repeated line, should the operator fail to make positional correction of the data sheet, from time to time. Furthermore, the prior devices make no adequate provision for ready selection among different positioning drives for the same data sheet; nor do such prior devices lend themselves to reversible operation.

It is accordingly an object of the invention to provide an improved copy holder of the character indicated.

Another object is to provide improved control means for line positioning in a copy holder of the character indicated.

A specific object is to provide a copy holder meeting the above objects with selective availability of a plurality of precisely limited and different drive increments appropriate to each of a plurality of different line-spacing features of a written data sheet to be copied.

Another specific object is to provide selective availability of forward-reverse motion in a device of the character indicated.

A general object is to meet the above objects with mechanism of compact yet rugged construction, featuring simple and foolproof control, and at relatively low cost.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figure 1:
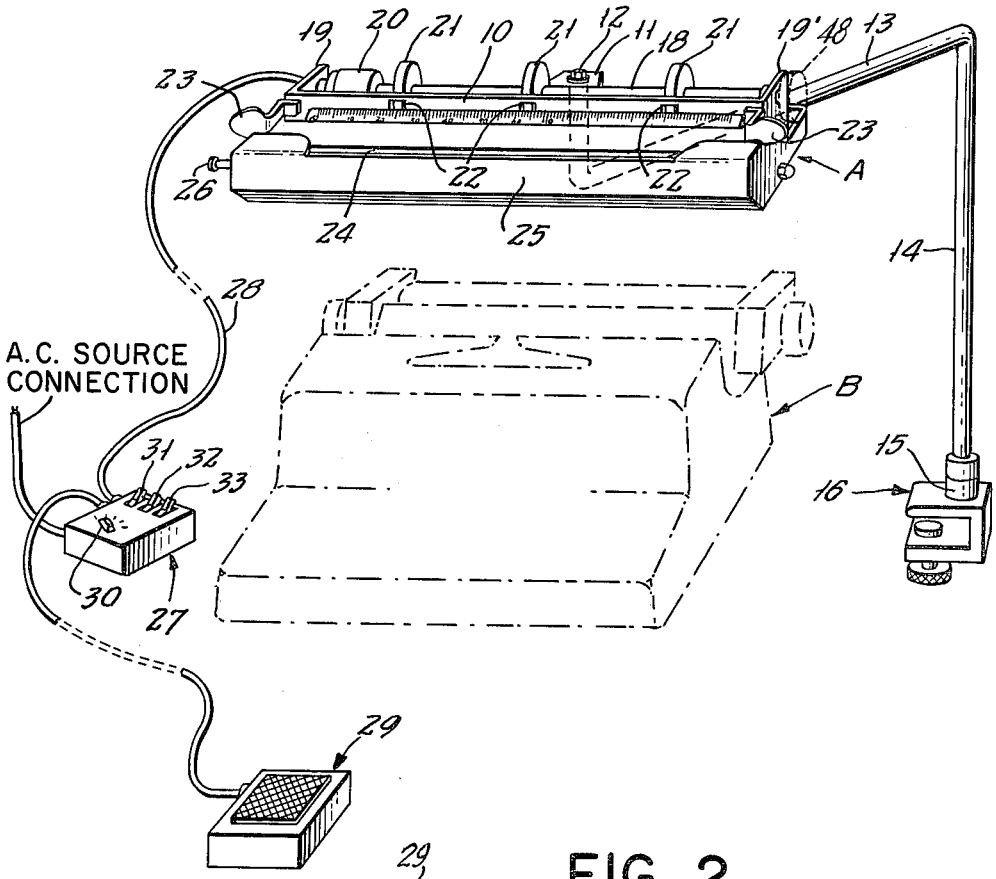
FIG. 1 is a simplified view in perspective of a copy holder of the invention, with phantom-outline of a typewriter, to show a typical installed relationship.

Referring initially to FIG. 1, the invention is shown in application to a copy holder head assembly A, positioned above and at the rear of a typewriter B, shown in phantom outline. The head assembly A comprises elongate frame structure including a horizontal member on face plate 10 and a central rear bracket 11 by means of which it is adjustably pivotable about the upturned end 12 of a supporting horizontal swing arm 13. Arm 13 has an upstanding post portion 14 rotatable in boss means 15 forming part of a clamp 16, by which the copy holder and its swing arm 13 are mounted to a typewriter table or the like. Set screw or the like means (not shown) at 11 and 15 will be understood to secure a desired position of adjustment of the head assembly A with respect to the typewriter B.

The head of the copy holder includes a horizontal platen shaft 18 supported for rotation between rearwardly bent ends 19–19' of the frame member 10, being shown journaled at the end 19' and coupled at its other end to the output shaft of a drive motor 20, the latter being fixedly mounted to frame member 10, at the end 19. Plural feed rolls 21 are fixed to platen shaft 18 at longitudinally spaced locations; rolls 21 carry elastomeric friction material at their circumference, and a forwardly extending portion thereof always protrudes through aligned slotted openings 22 in member 20, preferably slightly forward of the front face of member 20. A sheet of data or text (not shown) to be copied is fed from below and over the protruding portions of rolls 21, and will be understood to be resiliently pressed against these protruding portions by a correspondingly spaced series of pressure rolls, also not shown but described in detail in said U.S. Pat. No. 3,369,313. As also described in said patent, arms 23 constitute part of the bail structure which mounts the pressure rolls and which is resiliently loaded to urge the pressure rolls against platen rolls 21, via the inserted data sheet. Arms 23 project outwardly beyond the longitudinal ends of the frame, for finger engagement to relieve pressure-roll contact with the inserted sheet, as when positioning and aligning a freshly inserted data sheet to be copied. Forward of the described structure, a lamp 24 and its tiltably adjustable shield 25 are mounted to the copy holder head, the lamp being operable by a push-button switch 26.

In accordance with a feature of the invention, the drive motor 20 is of the positive-displacement pulse-operated variety, having an output-shaft displacement characteristic which is directly and necessarily determined by the time duration of a single pulse or of a succession of pulses, and a control-pulse signal generator for this motor provides ready selective availability of a plurality of different pulse outputs, each of which may be tailored to the particular single-space, double-space or other character of the written matter to be copied from the inserted data sheet. The control instrumentation for motor 20 is shown contained in a small housing 27 having flexible electrical connection 28 to motor 20, and a foot switch 29 on the floor has similar flexible connection to the control package 27. The control package 27 is shown to provide externally accessible function selection, involving four-position selector-switch means 30 (for selection of the motor-output function provided for any given depression of the foot switch 29), an ON/OFF switch 31, a MANUAL-/AUTO switch 32, and a FORWARD/REVERSE switch 33. The nature and cooperation of these control components, in conjunction with motor 20, will be better understood from further discussion having particular reference to FIGS. 2 and 3.

Figure 2:
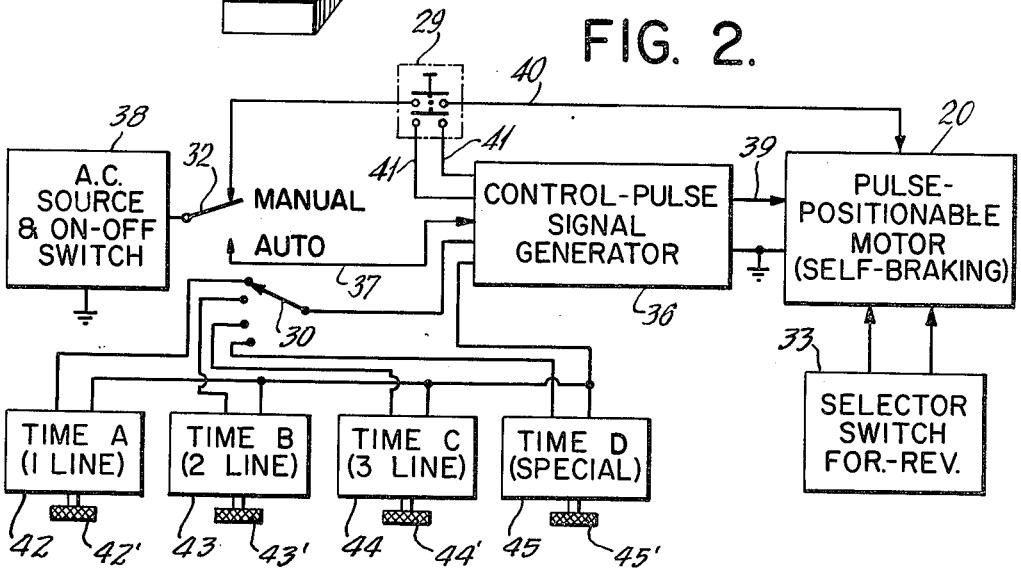
FIG. 2 is an electrical block diagram to show control and platen-positioning means for the copy holder of FIG. 1.

In FIG. 2, the control-pulse signal generator is identified at 36, being contained within package 27, and used only when switch 32 is in its "AUTO" position, in which case it has a first connection 37 to an A.C. source 38, as long as the ON/OFF switch 31 is set to the "ON" condition. Generator 36 provides its output via line 39 to motor 20. If the switch 32 is positioned for "MANUAL" operation, motor 20 is directly connectable via line 40 to the A.C. source 38 and will be driven at constant speed as long as the foot switch 29 is depressed; this will be understood to be part of a data-sheet set-up procedure, as when the data sheet is part of the web of a computer print-out. Should there be a positioning overshoot past the desired starting point for copying, the switch 33 is operated to reverse the drive, and foot switch 29 is depressed as long as needed to establish the desired starting point, switch 33 being then returned to its FORWARD-drive position.

Once the data sheet has been correctly positioned for start of copying operations, switch 32 should be set to its "AUTO" position, connecting the A.C. source to generator 36; in this "AUTO" selected relation, an additional set of contacts at foot switch 29 is operatively connected to generator 36, via line 41. When thus connected, each depression of the foot switch 29 is operative to determine a different control-pulse duration at output connection 39 to motor 20, depending upon the position or setting of selector switch 30. As shown, one of four time-determining elements 42–43–44–45 is operatively connected to generator 36, depending upon the setting of switch 30. Each of the elements 42–43–44–45 may, for example, be a trimmable resistor to function with a capacitance to determine a particular time constant for monostable multivibrator means contained in generator 36. Thus, for the case of element 42, the legend "Time A" will be understood to connote a pulse time required by motor 20 in order to develop a one-line incremental advance of the data sheet, driven by rolls 21; similarly, at elements 43 and 44, the legends "Time B" and "Time C" will be understood to connote the respective pulse times required by motor 20 to develop two-line and three-line incremental advances of the data sheet; and at element 45, with its manual adjustment "Time D" will be understood to connote some other and special-purpose operation of the motor 20, for a relatively wide range of adjustable selection of time duration, as for example, a 10-line advance for each depression of the foot switch 29. Each of the elements 42–43–44 is also shown with trimming means 42'–43'–44' whereby the pulse-output duration at 39 may be precisely set to accord with and exactly serve the actual line-spacing of text or other matter to be copied from the data sheet. Generally speaking, it is preferred that the trimming adjustments at 42'–43'–44'–45' be made only as part of a set-up procedure for the particular kind of data sheet to be accommodated; access to such trimming adjustments is therefore preferably available only by removing the cover of the housing package 27.

Figure 3:
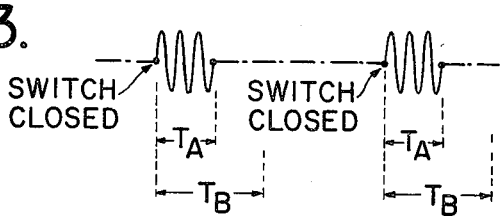
FIG. 3 is a simplified diagram of waveforms used in control and operation of the copy holder of FIG. 1.

In a preferred and illustrative embodiment of the invention, the motor 20 is a high-torque reversible, capacitor-run, synchronous hysteresis motor, with a reduction-gear output and with a self-braking feature, as available commercially from the Bristol-Saybrook Company, Old Saybrook, Connecticut. The self-braking feature assures against coasting when an excitation pulse (or wave train) terminates, the braking function being relieved while the motor is driven. The control-pulse signal generator 36 to function with such a motor 29 may utilize a solid-state A.C. Pulser chip circuit, being a product (Model #102515) of Digi-Pulse, Inc., of Plainview, New York. FIG. 3 shows the kind of pulse output thus provided, for the case of a one-line data-sheet advance, selected at 39 and involving element 42, to determine the control-pulse duration $T_A$; upon foot-switch closure, it is seen that a succession of cycles of the A.C.-source frequency (e.g., domestic 60 Hz supply) is supplied for the Time $T_A$, however long foot switch 29 is depressed, a release and succeeding operation of switch 29 being necessary to produce another "one-line" control-pulse wave train to motor 20 via line 39. An additional legend $T_B$ in FIG. 3 indicates that double the duration $T_A$ is involved for selection of a "Time B" or two-line advancing control pulse, and it will be understood that other selected pulse-output times are similarly produced, with precision angular shaft advance of motor 20, in accordance with either of the remaining selections at 30, it being understood in each case that only one motor advance follows from each depression of switch 29, however long switch 29 is depressed for an "AUTO" selected operation. Of course, for "MANUAL" operation, the motor 20 is driven as long as foot switch 29 is depressed, as explained above.

It will be seen that the described copy-holder device meets all stated objects. It is inherently precise as to each of the data-sheet advancing (or retracting) displacements called for by selector-switch positioning. In "AUTO" mode, one and only one precision displacement is made for each foot-switch closure, and the length of time the foot switch remains closed has no effect on the selected time duration of the motor-driving pulse signal.

While the invention has been described in detail for the preferred form shown, it will be understood that modifications may be made without departing from the scope of the invention. For example, in the event of suitable clutch means coupling motor 20 to the platen shaft 18, a manual knob (suggested at 48) on the platen shaft will permit manual adjustment of a given exposed-line position for a given sheet to be copied; such clutch means in the form of a two-way friction clutch is available as part of the above-described motor 20.

What is claimed is:

1. In a data-sheet handling copy holder for use as an adjunct to a typewriter or other operator-indexed data machine, the copy holder comprising a copy holder head, a platen having a shaft journaled in said head, pressure means carried by said head for coacting with the platen to hold a data sheet therebetween, and drive means for periodically incrementally advancing the angular position of said platen shaft, said drive means comprising a positive-displacement pulse-operated motor having an output shaft coupled to said platen shaft and producing an incremental angular output-shaft advance which is directly proportional to the time duration of an input control-pulse signal, and control means for said motor, said control means comprising pulse-generator means operatively connected to said motor for supplying a control-pulse signal of predetermined duration, the improvement wherein said control means includes selector-switch means providing a selected one of first and second selectively available control inputs to said pulse-generator means and respectively determining first and second control-pulse signal outputs of predetermined first and second time duration, and push-button means operative upon said generator means for initiating the production of a pulse of thus-selected duration.

2. The copy-holder improvement of claim 1, wherein said control means includes selectively variable means operative upon at least one of said control inputs to said pulse-generator means for selectively varying the effective time duration of said one control input.

3. The copy-holder improvement of claim 1, wherein said control means includes independently selectively variable means for each of said switch-selected control inputs for independently selectively varying the effective time duration of each of said control inputs.

4. The copy-holder improvement of claim 1, wherein said selector-switch means includes a further operative position in which said push-button means is operative to continuously drive said motor as long as said push button is actuated.

5. The copy-holder improvement of claim 1, in which said motor includes electrically operated brake means operative upon said output shaft to brake the same against coasting rotation.

6. The copy-holder improvement of claim 1, in which said control means includes selectively operable means for determining the drive direction of said motor shaft.

7. The copy-holder improvement of claim 1, in which said control means is contained in a control unit having flexible electric-cable connection to said copy-holder head.

8. The copy-holder improvement of claim 1, in which said push-button means is a foot switch having flexible electric-cable connection to said pulse-generator means.

9. The copy-holder improvement of claim 1, in which said motor is of the high-torque synchronous hysteresis variety.

10. The copy-holder improvement of claim 1, in which said motor includes a friction-clutch connection to said platen shaft, and externally accessible selectively operable means for manually adjusting the angular position of said platen shaft.

11. A data-sheet handling copy holder for use as an adjunct to a typewriter or other operator-indexed data machine, the copy holder comprising a copy holder head, a platen having a shaft journaled in said head, pressure means carried by said head for coacting with said platen to hold a data sheet therebetween, and reversible drive means for periodically incrementally advancing the angular position of said platen shaft, said drive means comprising a positive-displacement pulse-operated motor having an output shaft coupled to said platen shaft and producing an incremental angular output-shaft advance which is directly proportional to the time duration of an input control-pulse signal, and control means for said motor, said control means comprising pulse-generator means operatively connected to said motor for supplying a control-pulse signal of predetermined duration, said control means including first selectively operable means for selecting the direction of drive of said motor, second selectively operable means providing a selected one of first and second selectively available control inputs to said pulse-generator means and respectively determining first and second control-pulse signal outputs of predetermined first and second time duration, and push-button means operative upon said generator means for initiating the production of a pulse of thus-selected duration.

* * * * *